US010547928B1

(12) United States Patent
Luo

(10) Patent No.: US 10,547,928 B1
(45) Date of Patent: Jan. 28, 2020

(54) WIRELESS EARPHONE

(71) Applicant: Shenzhen Weiking Technology Co., Ltd., Shenzhen, Guangdong (CN)

(72) Inventor: Fuguang Luo, Guangdong (CN)

(73) Assignee: Shenzhen Weiking Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/273,118

(22) Filed: Feb. 11, 2019

(30) Foreign Application Priority Data

Oct. 2, 2018 (CN) ..... 2018 2 1617989 U

(51) Int. Cl.
*H04R 1/10* (2006.01)
*H04R 1/02* (2006.01)

(52) U.S. Cl.
CPC ..... *H04R 1/1025* (2013.01); *H04R 1/025* (2013.01); *H04R 1/1075* (2013.01); *H04R 2420/07* (2013.01)

(58) Field of Classification Search
CPC .... H04R 1/1025; H04R 1/025; H04R 1/1075; H04R 2420/07; H04R 1/10–1025; H04R 2220/30
See application file for complete search history.

(56) References Cited

U.S. PATENT DOCUMENTS 6,230,029 B1 * 5/2001 Hahn ..... H04B 1/385 379/430
9,049,515 B2 * 6/2015 Clow ..... H04R 1/1091
2008/0311966 A1 * 12/2008 Klein ..... H04M 1/05 455/575.2
2013/0287241 A1 * 10/2013 Prelogar ..... H04R 1/105 381/381
2019/0124431 A1 * 4/2019 Jeong ..... H04R 1/1025

* cited by examiner

*Primary Examiner* — Mark Fischer

(57) ABSTRACT

A wireless earphone includes a pair of wireless earphone bodies, each having an upper case and a ferromagnetic lower case detachably connected with each other. The upper case is provided with a first circuit board and a magnet. The first circuit board is electrically connected with a wireless module and a speaker. The ferromagnetic lower case is provided with a second circuit board and a rechargeable battery. One end of the upper case is provided with a first pogo pin electrically connected with the first circuit board. The ferromagnetic lower case is provided with a second pogo pin opposite to the first pogo pin and electrically connected to the second circuit board. The first pogo pin can couple with the second pogo pin so that the ferromagnetic lower case can magnetically couple with the upper case and provide electricity to the first circuit board.

11 Claims, 4 Drawing Sheets

WIRELESS EARPHONE

CROSS REFERENCE TO RELATED APPLICATIONS

The present application claims the benefit of Chinese Patent Application No. 201821617989.0 filed on Oct. 2, 2018, the contents of which are incorporated herein by reference in its entirety.

TECHNICAL FIELD

The present disclosure relates to the field of earphones, and in particular to a wireless earphone which is simple in structure, strong in endurance capability and convenient to carry around.

BACKGROUND

A wireless earphone is an application of wireless technology to a hands-free earphone so that a user can avoid the annoying wires and can easily talk and listen to music in various ways. Since the advent of the wireless earphone, it has been a good tool for mobile business people to improve efficiency. However, existing wireless earphones are all come with built-in rechargeable batteries. When the battery is low, the entire earphone must be taken out and charged. Hence, this causes inconvenience to the user. The user cannot use the wireless earphone as desired, and cannot meet the increasing demand of the user.

SUMMARY

In order to overcome the shortcomings of the prior art, the present disclosure aims to provide a wireless earphone which is simple in structure, strong in endurance capability and convenient to carry around.

The present disclosure can be achieved by the following technical measures. Wireless earphone may include a pair of wireless earphone bodies. Each wireless earphone body may include an upper case and a ferromagnetic lower case detachably connected with each other. The upper case may be provided therein with a first circuit board and a magnet. The first circuit board may be electrically connected with a wireless module and a speaker. The ferromagnetic lower case may be provided therein with a second circuit board and a rechargeable battery. One end of the upper case may be provided with a first pogo pin electrically connected with the first circuit board. The ferromagnetic lower case may be provided with a second pogo pin opposite to the first pogo pin and electrically connected to the second circuit board. The first pogo pin can cooperatively couple with the second pogo pin so that the ferromagnetic lower case can magnetically couple with the upper case and provide electricity to the first circuit board.

In a preferred embodiment, the first pogo pin is a female pogo pin and the second pogo pin is a male pogo pin.

In a preferred embodiment, the ferromagnetic lower case is a metal lower case.

In a preferred embodiment, the upper case is a plastic upper case.

In a preferred embodiment, the wireless earphone may further include a charging box. A base of the charging box may be provided with at least two storage troughs for storing the wireless earphone bodies, and at least two charging troughs for charging the ferromagnetic lower case.

In a preferred embodiment, the base of the charging box may be provided with a charging circuit board. An outer surface of the base of the charging box may be provided with a charging port controlled by the charging circuit board. The charging trough may be provided with a third pogo pin cooperatively coupled with the second pogo pin. The third pogo pin may be electrically connected with the charging circuit board.

In a preferred embodiment, an upper portion of the storage troughs may extend to two sides to form two hand-grasping portions.

In a preferred embodiment, the base of the charging box is connected with and coverable by an upper cover.

The present disclosure may be made up of an upper case and a ferromagnetic lower case detachably connected with each other. The upper case may be provided with a magnet capable of magnetically attracting the ferromagnetic lower case. The ferromagnetic lower case may be provided with a rechargeable battery. One end of the upper case may be provided with a first pogo pin. The ferromagnetic lower case may be provided with a second pogo pin opposite to the first pogo pin. The first pogo pin may cooperatively couple with the second pogo pin. The ferromagnetic lower case can be magnetically attracted to the upper case and supply electricity to the electronic components in the upper case.

Therefore, when the power of the rechargeable battery is low, a user can directly remove and replace the ferromagnetic lower case so that the user can use the wireless earphone at any time, without worrying about the condition of the power of the rechargeable battery. This can greatly improve the endurance of the wireless earphone. The wireless earphone is simple in structure and easy to carry around.

DETAILED DESCRIPTION

Figure 1:
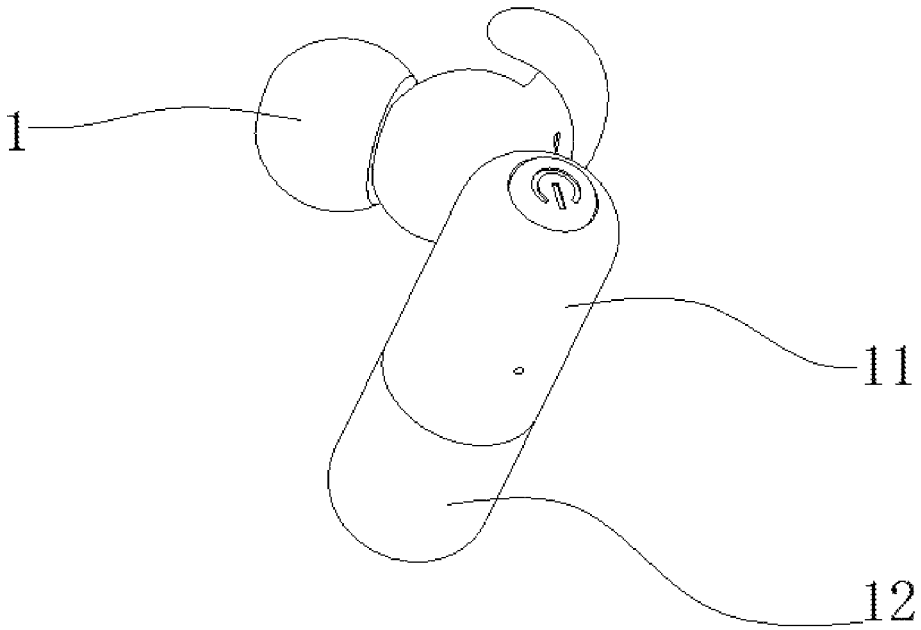
FIG. 1 is a schematic structural view of a wireless earphone body according to an embodiment of the present disclosure.

The present disclosure will be further described in detail below with reference to the embodiments and with reference to the accompanying drawings.

Referring to FIGS. 1-7, a wireless earphone may include a pair of wireless earphone bodies 1. Each wireless earphone body 1 may include an upper case 11 and a ferromagnetic lower case 12 detachably connected with each other. The upper case 11 may be provided therein with a first circuit board 111 and a magnet 112. The first circuit board 111 may be electrically connected with a wireless module 113 and a speaker 114. The ferromagnetic lower case 12 may be provided therein with a second circuit board 121 and a rechargeable battery 122. One end of the upper case 11 may be provided with a first pogo pin 115 electrically connected with the first circuit board 111. The ferromagnetic lower case 12 may be provided with a second pogo pin 123 opposite to the first pogo pin 115 and electrically connected to the second circuit board 121. The first pogo pin 115 can cooperatively couple with the second pogo pin 123 so that the ferromagnetic lower case 12 can magnetically couple with the upper case 11 and provide electricity to the first circuit board 111.

The present disclosure may be made up of an upper case 11 and a ferromagnetic lower case 12 detachably connected with each other. The upper case 11 may be provided with a magnet 112 capable of magnetically attracting the ferromagnetic lower case 12. The ferromagnetic lower case 12 may be provided with a rechargeable battery 122. One end of the upper case 11 may be provided with a first pogo pin 115. The ferromagnetic lower case 12 may be provided with a second pogo pin 123 opposite to the first pogo pin 115. The first pogo pin 115 may cooperatively couple with the second pogo pin 123. The ferromagnetic lower case 12 can be magnetically attracted to the upper case 11 and supply electricity to the electronic components in the upper case 11. Therefore, when the power of the rechargeable battery 122 is low, a user can directly remove and replace the ferromagnetic lower case 12 so that the user can use the wireless earphone at any time, without worrying about the condition of the power of the rechargeable battery 122. This can greatly improve the endurance of the wireless earphone. The wireless earphone is simple in structure and easy to carry around. This can enhance the market competitiveness of the product.

Figure 2:
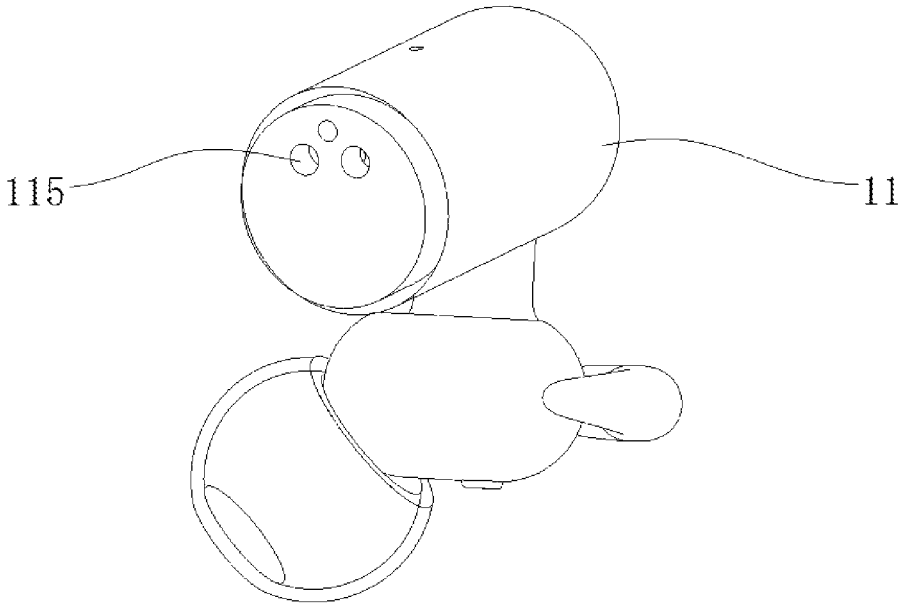
FIG. 2 is a schematic structural view of an upper case according to an embodiment of the present disclosure.
Figure 3:
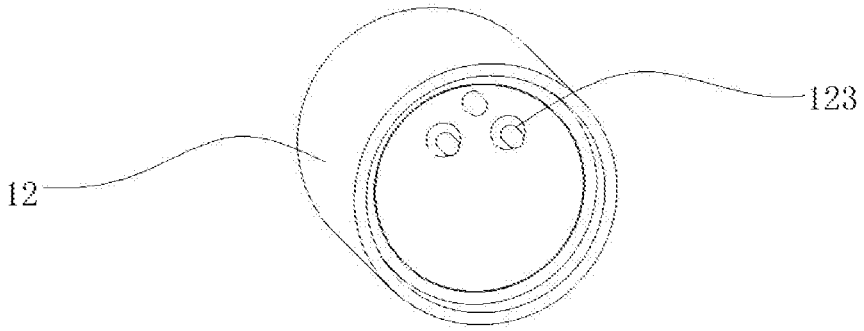
FIG. 3 is a schematic structural view of a ferromagnetic lower case according to an embodiment of the present disclosure.
Figure 4:
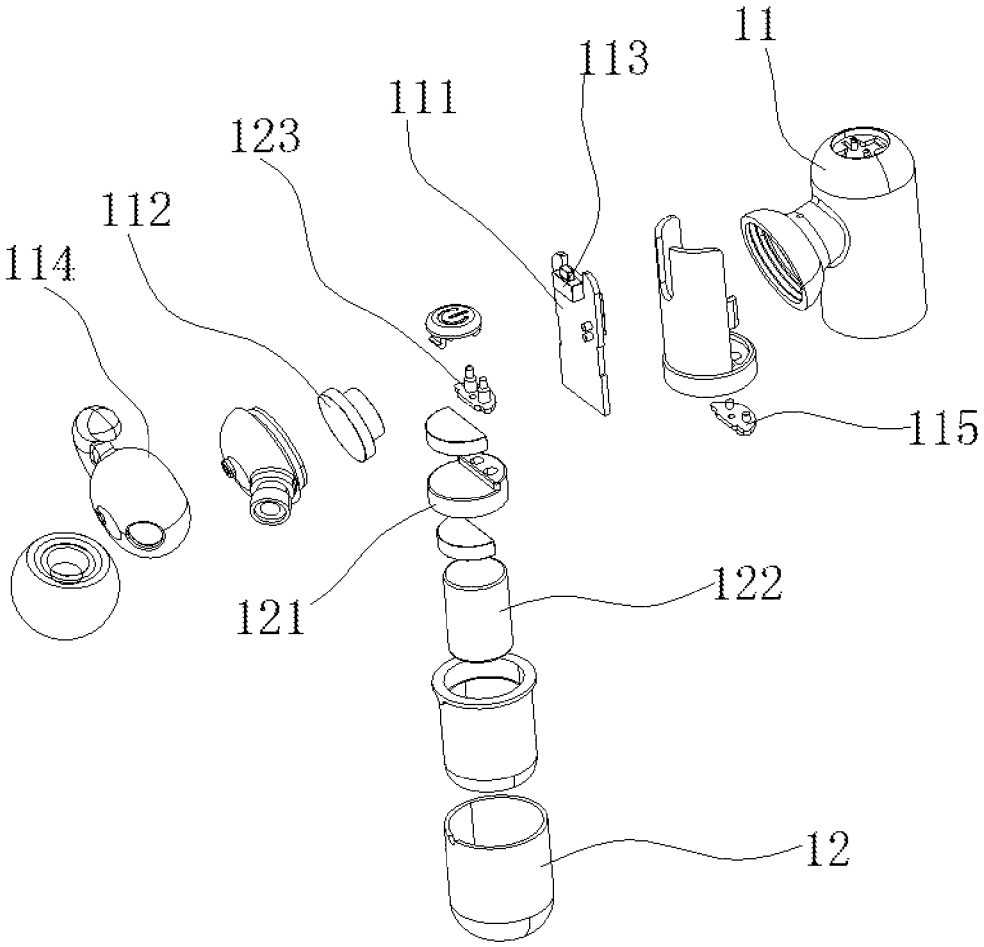
FIG. 4 is an exploded view of the wireless earphone body according to an embodiment of the present disclosure.
Figure 5:
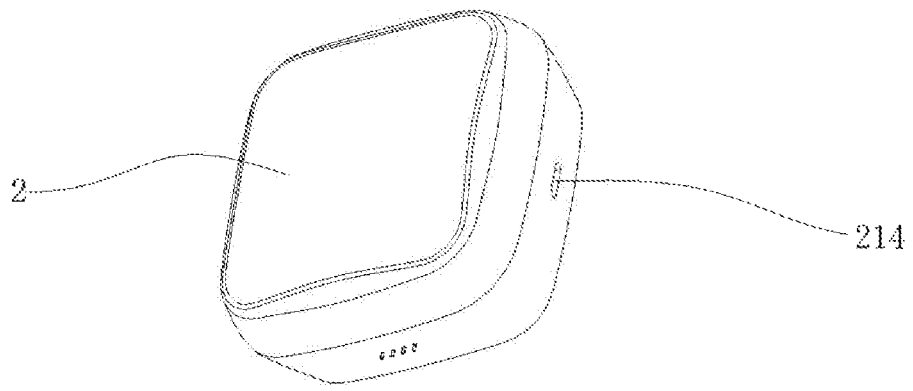
FIG. 5 is a schematic structural view of a charging box according to an embodiment of the present disclosure.

In an embodiment of the wireless earphone shown in FIGS. 2 and 3 and based on the foregoing technical solution, the first pogo pin 115 may be a female pogo pin and the second pogo pin 123 may be a male pogo pin. Of course, in another embodiment, the first pogo pin 115 may be a male pogo pin and the second pogo pin 123 may be a female pogo pin.

In an embodiment of the wireless earphone shown in FIG. 3 and based on the foregoing technical solution, the ferromagnetic lower case 12 may be a metal lower case. Hence, the heat dissipation capability can be stronger and the structure can be stronger.

In an embodiment of the wireless earphone shown in FIG. 2 and based on the foregoing technical solution, the upper case 11 may be a plastic upper case. This can reduce the weight of the earphone, making it more portable. Furthermore, this can reduce resonance and ensure the sound quality of the earphone.

Figure 6:
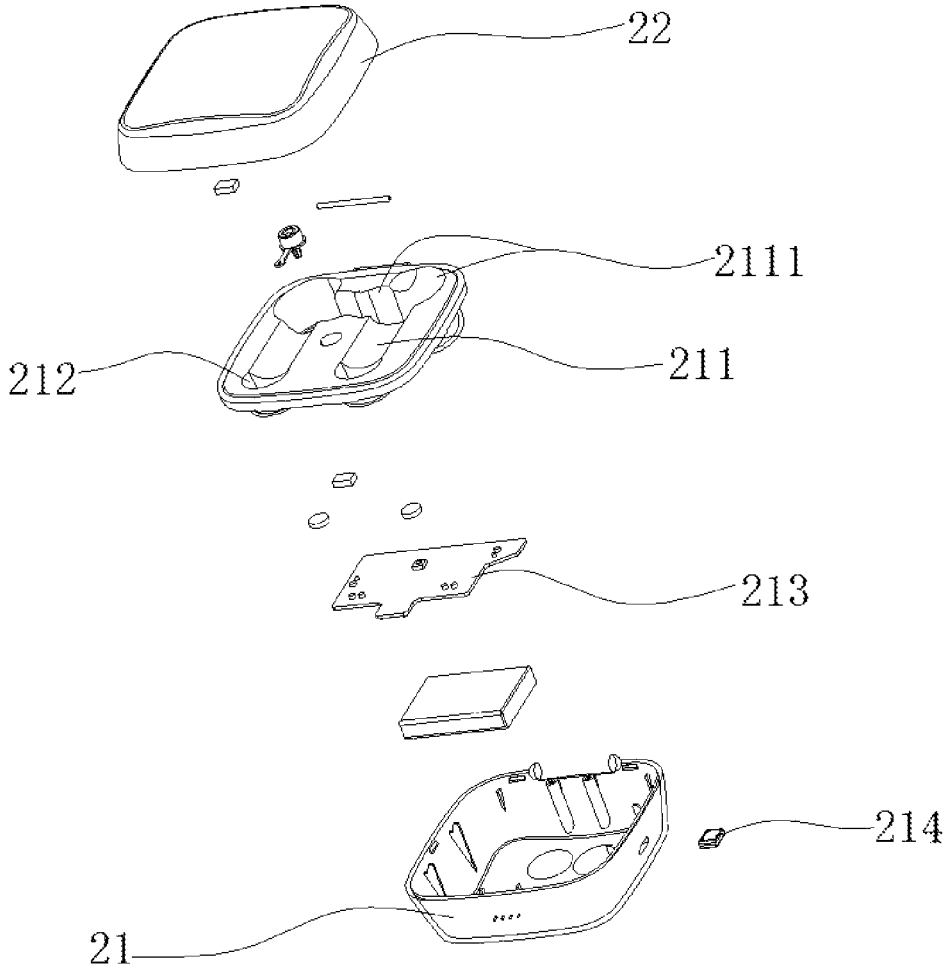
FIG. 6 is an exploded view of the charging box of the embodiment of the present disclosure.

In an embodiment of the wireless earphone shown in FIG. 6 and based on the foregoing technical solution, the wireless earphone may further include a charging box 2. A base 21 of the charging box 2 may be provided with at least two storage troughs 211 for storing the wireless earphone bodies 1, and at least two charging troughs 212 for charging the ferromagnetic lower case 12. Of course, in another embodiment, there may be only one charging trough.

In an embodiment of the wireless earphone shown in FIG. 6 and based on the foregoing technical solution, the base 21 of the charging box 2 may be provided with a charging circuit board 213. An outer surface of the base 21 of the charging box 2 may be provided with a charging port 214 controlled by the charging circuit board 213. The charging trough 212 may be provided with a third pogo pin cooperatively coupled with the second pogo pin 123. The third pogo pin may be electrically connected with the charging circuit board 213. Therefore, the charging port 214 can connect to external power source to charge the charging box 2. The charging trough 212 can charge the rechargeable battery 122.

In an embodiment of the wireless earphone shown in FIG. 6 and based on the foregoing technical solution, an upper portion of the storage troughs 211 may extend to two sides to form two hand-grasping portions 2111. Thus, the wireless earphone bodies 1 can be easily taken out from the storage troughs 211.

Figure 7:
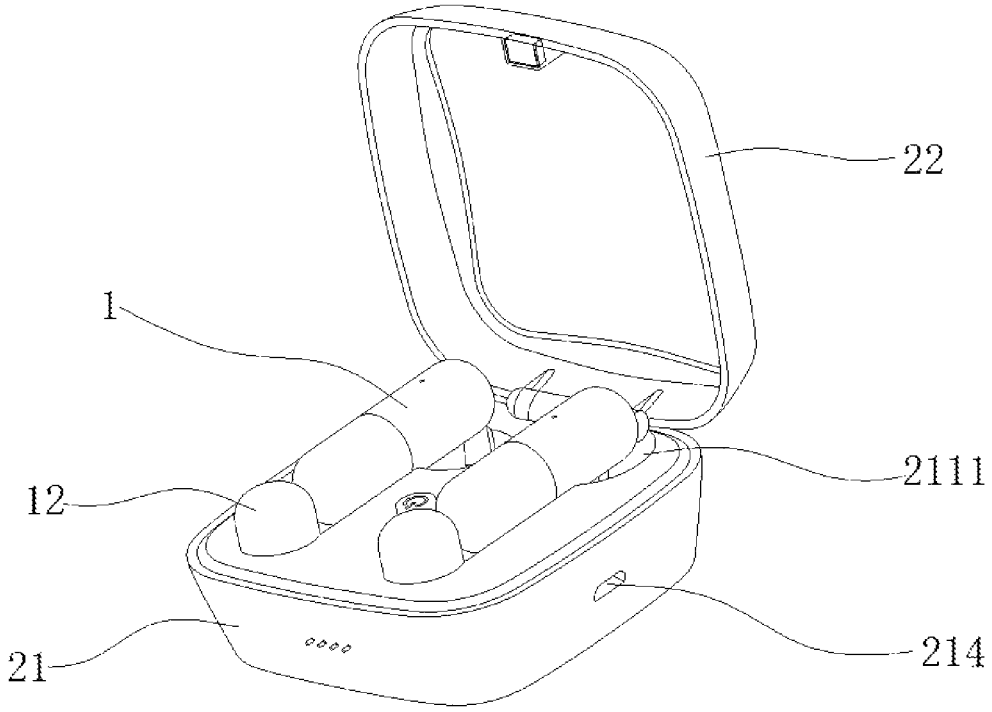
FIG. 7 is a diagram showing the state of use according to an embodiment of the present disclosure.

In an embodiment of the wireless earphone shown in FIG. 7 and based on the foregoing technical solution, the base 21 of the charging box 2 may be connected with and coverable by an upper cover 22. Therefore, the wireless earphone bodies 1 and the ferromagnetic lower case 12 would not fall out from the charging box 2 and can easily be stored.

The above is a description of the wireless earphone of the present disclosure for helping to understand the present disclosure. However, the embodying of the present disclosure is not limited by the above embodiments. Any changes, modifications, substitutions, combinations, simplifications, and equivalent replacements made without departing from the principles of the present disclosure are all included in the scope of protection of the present disclosure.

What is claimed is:

1. A wireless earphone, comprising a pair of wireless earphone bodies, each wireless earphone body comprising an upper case and a ferromagnetic lower case detachably connected with each other, the upper case being provided therein with a first circuit board and a magnet, the first circuit board being electrically connected with a wireless module and a speaker, the ferromagnetic lower case being provided therein with a second circuit board and a rechargeable battery, wherein one end of the upper case is provided with a first pogo pin electrically connected with the first circuit board, and the ferromagnetic lower case is provided with a second pogo pin opposite to the first pogo pin and electrically connected to the second circuit board, wherein the first pogo pin is capable of cooperatively coupling with the second pogo pin, so that the ferromagnetic lower case is capable of magnetically coupling with the upper case and providing electricity to the first circuit board.

2. The wireless earphone according to claim 1, wherein the first pogo pin is a female pogo pin and the second pogo pin is a male pogo pin.

3. The wireless earphone according to claim 2, further comprising a charging box, a base of the charging box is provided with at least two storage troughs for storing the wireless earphone bodies, and at least two charging troughs for charging the ferromagnetic lower case.

4. The wireless earphone according to claim 1, wherein the ferromagnetic lower case is a metal lower case.

5. The wireless earphone according to claim 4, further comprising a charging box, a base of the charging box is provided with at least two storage troughs for storing the wireless earphone bodies, and at least two charging troughs for charging the ferromagnetic lower case.

6. The wireless earphone according to claim 1, wherein the upper case is a plastic upper case.

7. The wireless earphone according to claim 6, further comprising a charging box, a base of the charging box is provided with at least two storage troughs for storing the wireless earphone bodies, and at least two charging troughs for charging the ferromagnetic lower case.

8. The wireless earphone according to claim 1, further comprising a charging box, a base of the charging box is provided with at least two storage troughs for storing the wireless earphone bodies, and at least two charging troughs for charging the ferromagnetic lower case.

9. The wireless earphone according to claim 8, wherein the base of the charging box is provided with a charging circuit board, an outer surface of the base of the charging box is provided with a charging port controlled by the charging circuit board, the charging trough is provided with a third pogo pin cooperatively coupled with the second pogo pin, the third pogo pin is electrically connected with the charging circuit board.

10. The wireless earphone according to claim 8, wherein an upper portion of the storage troughs extends to two sides to form two hand-grasping portions.

11. The wireless earphone according to claim 8, wherein the base of the charging box is connected with and coverable by an upper cover.

* * * * *